US008052246B2

(12) United States Patent
Yamamoto

(10) Patent No.: US 8,052,246 B2
(45) Date of Patent: Nov. 8, 2011

(54) RECORDING DEVICE AND RECORDING MEDIUM CONVEYING METHOD

(75) Inventor: Hideki Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 528 days.

(21) Appl. No.: 12/324,395

(22) Filed: Nov. 26, 2008

(65) Prior Publication Data

US 2009/0141070 A1 Jun. 4, 2009

(30) Foreign Application Priority Data

Nov. 30, 2007 (JP) ..... 2007-309894

(51) Int. Cl.
*B41J 2/165* (2006.01)

(52) U.S. Cl. ..... 347/22; 347/33

(58) Field of Classification Search ..... 347/14, 347/20, 22–23, 139; 399/98, 301
See application file for complete search history.

(56) References Cited

FOREIGN PATENT DOCUMENTS

JP 2006-187979 A 7/2006

*Primary Examiner* — Stephen Meier
*Assistant Examiner* — Tracey McMillion
(74) *Attorney, Agent, or Firm* — Banner & Witcoff, Ltd.

(57) ABSTRACT

A cleaning roller is arranged at a position facing an image sensor with a conveying belt interposed therebetween. The conveying belt has a through hole. In an image sensor cleaning mode, the cleaning roller is inserted through the through hole and contacts the image sensor, while the image sensor is held without moving.

21 Claims, 5 Drawing Sheets

RECORDING DEVICE AND RECORDING MEDIUM CONVEYING METHOD

CROSS REFERENCE TO RELATED APPLICATION

This application claims priority from Japanese Patent Application No. 2007-309894, filed Nov. 30, 2007, the entire subject matter of which is incorporated herein by reference.

BACKGROUND

1. Field

Aspects of the present invention relate to a recording device and a recording medium conveying method.

2. Description of the Related Art

A known recording device conveys a sheet as a recording medium, and records an image on the sheet by ejecting ink from a plurality of nozzles. The recording device checks ejection of ink from nozzles. In the recording device, a chart is printed on a conveying belt, and a reading portion arranged adjacent to a head reads the chart, so as to detect an ink-ejection failure of nozzles. Herein, the reading member is sealed to prevent foreign substances floating in the device, such as ink mist or paper dust, from adhering to the reading member. Also, the reading member is cleaned to prevent an erroneous detection from occurring due to foreign substances adhering to the reading member.

With the configuration, a mechanism for moving the reading member has to be provided. Thus, the configuration of the device may be complicated.

SUMMARY

Certain illustrative aspects of the present invention provide a recording device and a recording medium conveying method which do not require a mechanism for moving a reading member and thus simplify a configuration of the device. According to an aspect of the present invention, a recording device may comprise a conveying member having a through hole, the conveying member conveying a recording medium, which is placed on a first surface of the conveying member on a front side. The recording device may further comprise a reading member arranged to face the first surface of the conveying member, the reading member reading an image on the first surface or an image on the recording medium on the first surface. The recording device may also comprise a cleaning member arranged to face a second surface of the conveying member on a back side, at a position facing the reading member with the conveying member interposed therebetween, the cleaning member cleaning the reading member.

According to another aspect of the present invention, a method may include providing a reading member facing a first surface on a front side of a conveying member, the conveying member having a through hole, and providing a cleaning member at a position facing a second surface on a back side of the conveying member, the position facing the reading member with the through hole interposed therebetween. The method may further include moving the conveying member to position the through hole between the reading member and the cleaning member, and cleaning the reading member with a cleaning member that passes through the through hole of the conveying member.

Other aspects will be apparent to those skilled in the art from the following detailed description and accompanying drawings.

DETAILED DESCRIPTION

An illustrative embodiment of the present invention, and their features and advantages, may be understood with reference to the attached drawings, like numerals being used for corresponding parts in the various drawings.

Figure 1:
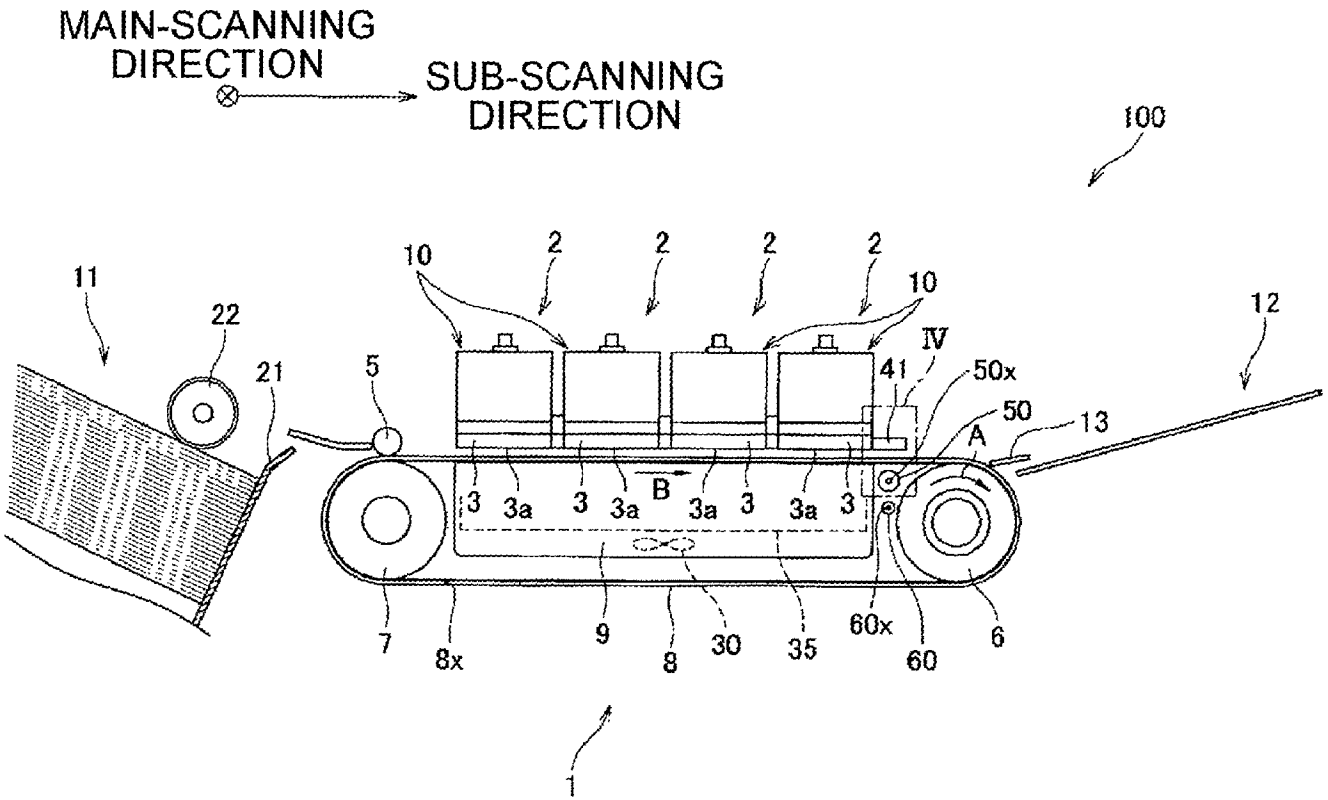
FIG. 1 is a side view schematically showing a general configuration of an inkjet printer, which is an illustrative embodiment of the present invention.

Referring to FIG. 1, the inkjet printer 100 may be a color inkjet printer comprising a plurality of, e.g., four, inkjet heads 2 which respectively eject ink of magenta, cyan, yellow, and black.

The plurality of inkjet heads 2 may extend in a main-scanning direction (i.e., direction orthogonal to a sheet plane of FIG. 1), and may be arranged in a sub-scanning direction (i.e., direction being orthogonal to the main-scanning direction and extending along a conveying direction B). The plurality of inkjet heads 2 may be supported by a printer body via a frame. The inkjet printer 100 may be a line printer having an ejection region extending in the main-scanning direction.

Each inkjet head 2 may include a head body 3 arranged at a lower end, and a reservoir unit 10 fixed to an upper surface of the head body 3. The head body 3 may have a rectangular-parallelepiped shape elongated in the main-scanning direction, in which a flow-path unit and actuators are bonded. The flow-path unit may include a plurality of individual ink flow paths containing pressure chambers. The actuators selectively may apply pressure to ink in the pressure chambers. A lower surface of the head body 3 may serve as an ejection surface 3*a*. Nozzles for ejecting ink may be formed in the ejection surface 3*a*. The reservoir unit 10 temporarily may store ink therein, and may supplies ink to the head body 3.

A sheet-conveying path may be formed in the inkjet printer 100. A sheet may be conveyed from a feed mechanism 11 to a discharge unit 12 through the sheet-conveying path. The feed mechanism 11 may comprise a pickup roller 22. When the pickup roller 22 is rotated by driving of a pickup motor 132 (see FIG. 3), the pickup roller 22 may pick up a top sheet in a sheet tray 21, and may feed the sheet from the left side toward the right side in FIG. 1.

The sheet conveying device 1 may be positioned at an intermediate portion of the sheet-conveying path. The sheet conveying device 1 may comprise a plurality of, e.g., two, belt rollers 6 and 7, and a conveying member such as an endless conveying belt 8 wound around the belt rollers 6 and 7. The belt roller 6 may receive a driving force from a conveyance motor 133 (see FIG. 3), and may rotate clockwise (direction indicated by arrow A in FIG. 1). The belt roller 7 may rotate clockwise when the conveying belt 8 travels by the driving of the belt roller 6.

Figure 2:
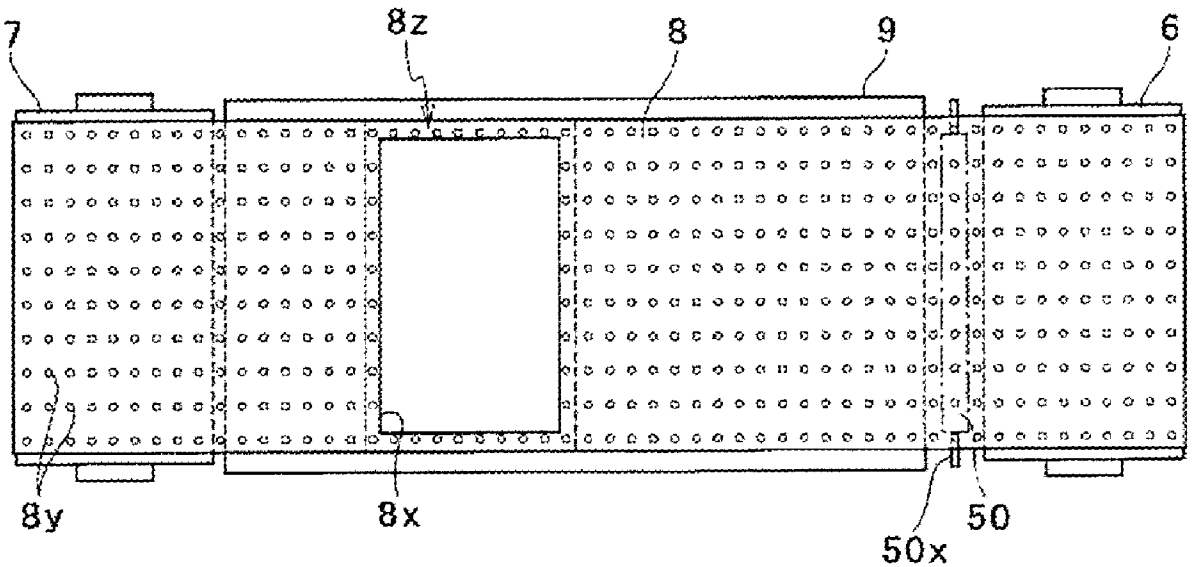
FIG. 2 is a plan view showing a conveying belt.

Referring to FIG. 2, the conveying belt 8 may comprise a plurality of small suction holes 8*y* over the entire surface. The suction holes 8*y* may penetrate from an outer peripheral surface to an inner peripheral surface of the conveying belt 8. The outer peripheral surface may be positioned on a front side of the conveying belt 8. The inner peripheral surface may be positioned on a back side of the conveying belt 8. A suction fan 30 (see FIG. 1) may be arranged in a region surrounded by the conveying belt 8, that is, within a loop. When the suction fan 30 is driven, the air may be sucked from the outer peripheral surface to the inner peripheral surface of the conveying belt 8 through the suction holes 8*y* in the sheet-conveying path. Accordingly, a sheet placed on the conveying belt 8 may be held on the outer peripheral surface of the conveying belt 8.

A pressure roller 5 may be arranged directly downstream of the feed mechanism 11 in a sheet conveying direction, so as to face the conveying belt 8. The pressure roller 5 may press the sheet fed from the feed mechanism 11 to the outer peripheral surface of the conveying belt 8. The sheet pressed to the outer peripheral surface of the conveying belt 8 may be conveyed in the conveying direction B while being held on the outer peripheral surface by a suction force.

A separation plate 13 may be positioned directly downstream of the conveying belt 8 along the sheet-conveying path. The separation plate 13 may separate the sheet, which is held on the outer peripheral surface of the conveying belt 8, from the outer peripheral surface, and may feed the sheet to the discharge unit 12 at the right side.

A substantially rectangular-parallelepiped platen 9 may be arranged within the loop of the conveying belt 8, so as to face the plurality of inkjet heads 2. An upper surface of the platen 9 may be in contact with the inner peripheral surface of an upper portion of the loop of the conveying belt 8. The platen 9 may support the conveying belt 8 from the inner back side. Accordingly, the outer peripheral surface of the upper portion of the loop of the conveying belt 8 and the lower surfaces of the inkjet heads 2, that is, the ejection surfaces 3*a* may face each other and may be in parallel to each other, with a small gap interposed between the ejection surfaces 3*a* and the outer peripheral surface of the conveying belt 8. The gap may define a part of the sheet-conveying path. When the sheet, which is conveyed by the conveying belt 8 while the sheet is held on the outer peripheral surface of the conveying belt 8, successively passes through areas directly below the four head bodies 3, respective color inks may be ejected onto an upper surface of the sheet. Hence, a desired color image may be formed on the sheet.

The platen 9 may have an opening in an upper surface thereof in an area facing the ejection surfaces 3*a* of the inkjet heads 2. In the platen 9, a tray 35 may be arranged to entirely cover the ejection surfaces 3*a* of the plurality of inkjet heads 2. The tray 35 may have a rectangular bottom surface to face the four ejection surfaces 3*a*. The conveying belt 8 may have a rectangular through hole 8*x*, which penetrates from the outer peripheral surface to the inner peripheral surface of the conveying belt 8, and may have a size equivalent to the size of the ejection surface 3*a* of a single inkjet head 2. So-called flushing may be performed for each inkjet head 2, in which ink is forcibly ejected from the ejection surface 3*a* so as to restore ink-ejection performance of the inkjet head 2. When the flushing is performed, the conveying belt 8 may be stopped at a position in which the through hole 8*x* faces the ejection surface 3*a*. The ink ejected from the ejection surface 3*a* during the flushing may pass through the through hole 8*x* of the conveying belt 8 and through the opening of the platen 9. Then, the ink may be received by the tray 35.

A peripheral edge 8*z* of the through hole 8*x* is reinforced. For example, the through hole 8*x* is formed of a material having a higher density than a material of other portions of the conveying belt 8, or a reinforcing member is added to the peripheral edge 8*z*.

An illustrative reading member, such as image sensor 41 may be positioned on a downstream-side surface of the inkjet head 2 located at the most downstream side in the sheet conveying direction. The image sensor 41 may be a line sensor which includes an image pickup element formed of, for example, a contact image sensor (CIS), a charge-coupled device (CCD) or a complementary metal-oxide semiconductor device (CMOS), and which has an image pickup area extending in the main-scanning direction. The image sensor 41 may read an image formed on the outer peripheral surface of the conveying belt 8, or an image formed on a sheet on the outer peripheral surface. When the inkjet printer 100 is in an ejection failure inspection mode, the image sensor 41 may read an image of a test chart formed on the outer peripheral surface of the conveying belt 8. When the inkjet printer 100 is in a conveyance failure inspection mode, the image sensor 41 may read an image formed on the sheet being conveyed by the conveying belt 8.

A lower surface, that is, a reading surface of the image sensor 41 may be parallel to the lower surface, that is, the ejection surface 3*a* of the inkjet head 2, at the same height, so as to be parallel with and face the outer peripheral surface of the upper portion of the loop of the conveying belt 8. A distance to the reading surface from the outer peripheral surface of the upper portion of the loop of the conveying belt 8 may be previously determined so that the image sensor 41 can read the image formed on the outer peripheral surface. Also, a distance to the reading surface from the upper surface of the sheet placed on the outer peripheral surface may be previously determined so that the image sensor 41 can read the image on the sheet. That is, the distances may be previously determined so that image data obtained when the image sensor 41 captures the images represent images in focus.

The image pickup area of the image sensor 41 may have a length in the main-scanning direction equivalent to that of a printable area of the inkjet head 2. In contrast, the sheet to be conveyed by the conveying belt 8 (i.e., length of the inkjet head 2 in the main-scanning direction) may have a width slightly smaller than that of the printable area of the inkjet head 2. Accordingly, even when the sheet is slightly shifted in a width direction thereof during conveyance, the image sensor 41 may be able to capture an image of the sheet for the entire width of the sheet.

A cleaning member, for example cleaning roller 50, and an adhesive roller 60 may be positioned within the loop of the conveying belt 8, at positions facing the image sensor 41 with the conveying belt 8 interposed therebetween. The cleaning roller 50 may be used to clean the reading surface of the image sensor 41. The adhesive roller 60, acting as a removal portion, may be used to restore the cleaning power of the cleaning roller 50 by removing foreign substances or contaminants, such as ink or paper dust, which adhere to the surface of the cleaning roller 50. Alternatively, a brush roller with a collector for receiving contaminants brushed off the cleaning roller 50 by the brush roller may be used in place of the adhesive roller 60. Also, a roller with attractive forces (e.g., static electricity, magnetic) may be used in place of the adhesive roller 60.

The cleaning roller 50 and the adhesive roller 60 may be supported by the printer body via shafts 50*x* and 60*x* extending in the main-scanning direction (i.e., direction orthogonal to the sheet plane of FIG. 1). The cleaning roller 50 and the adhesive roller 60 may be rotatable clockwise and counterclockwise in FIG. 1. The cleaning roller 50 may be movable in up-down and left-right directions via the shaft 50*x* by driving a moving mechanism 70 (see FIG. 3) from a home position (i.e., position indicated by a dotted line in FIGS. 4A to 4C), in which the cleaning roller 50 does not contact any of the image sensor 41, the conveying belt 8, and the belt roller 6. Lengths of the cleaning roller 50 and the adhesive roller 60 in an axial direction may be equivalent to the length of the reading surface of the image sensor 41 in the same direction. The cleaning roller 50 can be formed of a sponge-like, elastic, porous material. The adhesive roller 60 can be formed of a hard material. The surface of the adhesive roller 60 can be treated to be adhesive.

Figure 4A:
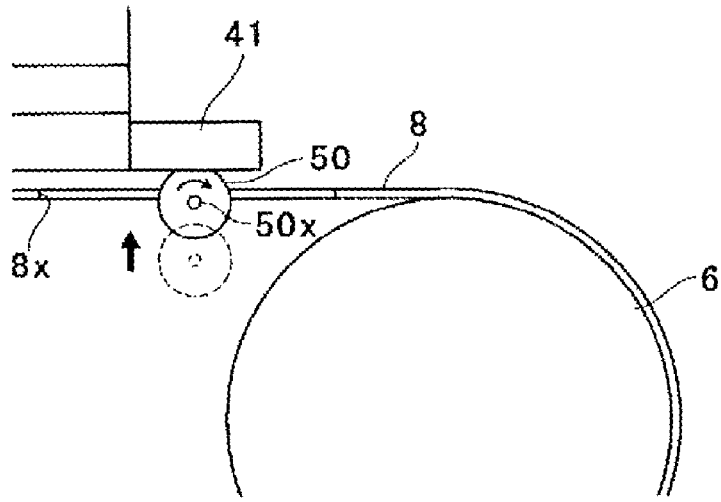
FIGS. 4A to 4C are enlarged views of a region IV surrounded by a dotted-chain line in FIG. 1, FIG. 4A illustrating an operation of a cleaning roller in an image sensor cleaning mode, FIG. 4B illustrating an operation of the cleaning roller in a belt back surface cleaning mode, FIG. 4C illustrating an operation of the cleaning roller in a belt roller cleaning mode.

Referring to FIGS. 2 and 4A, the through hole 8*x* of the conveying belt 8 has a size through which the cleaning roller 50 can bepassed.

Figure 3:
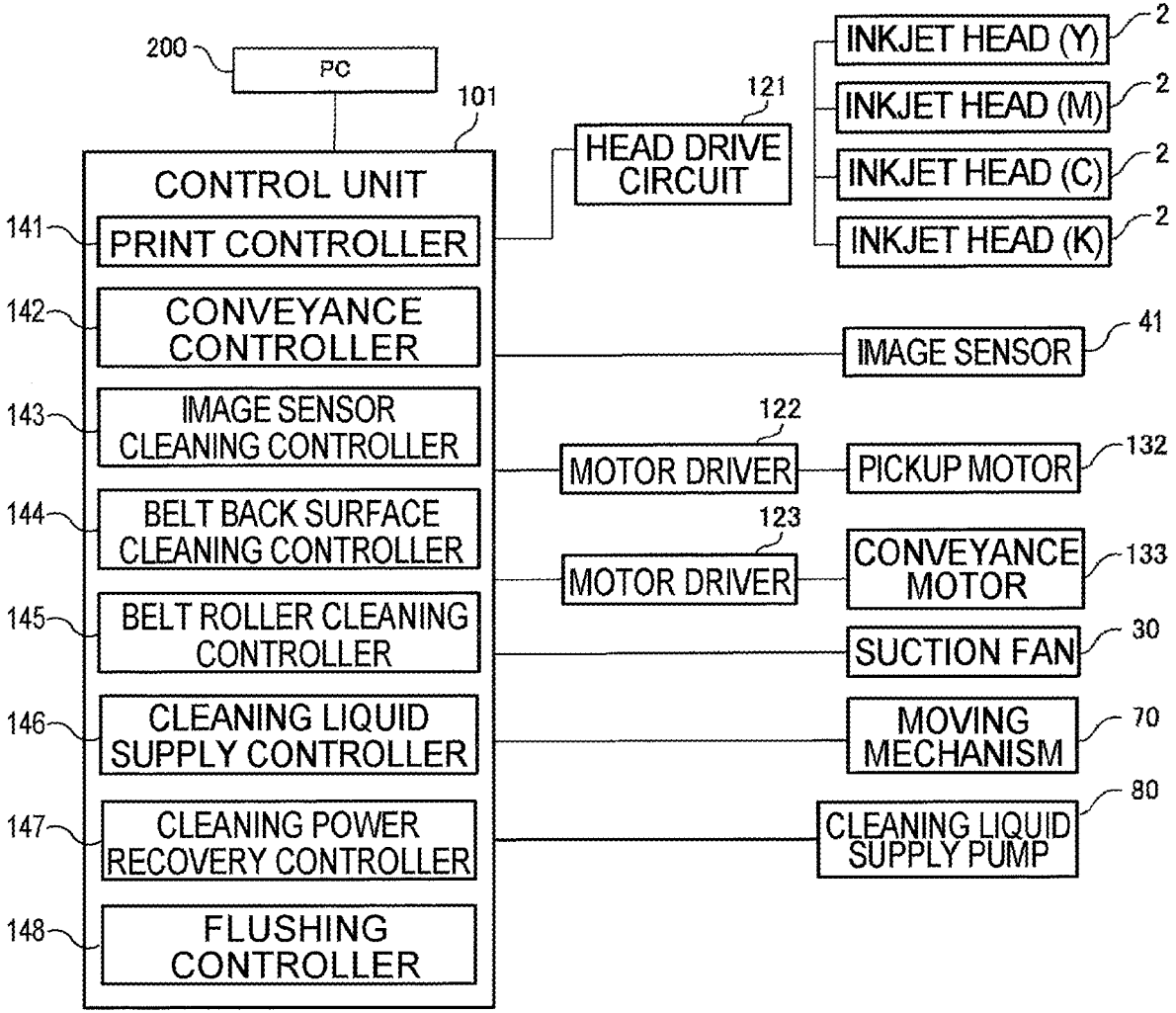
FIG. 3 is a block diagram showing an electric configuration of the inkjet printer.

Referring to FIG. 3, the inkjet printer 100 may comprise a control unit 101 that controls an operation of the inkjet printer 100. The control unit 101 may comprise a central processing unit (CPU) serving as an arithmetic processing unit, a read-only memory (ROM) which stores a control program to be executed by the CPU and data to be used for the control program, and a random access memory (RAM) which temporarily stores data when the program is executed. These components may serve as a print controller 141, a conveyance controller 142, an image sensor cleaning controller 143, a conveying member cleaning controller (e.g., belt back surface cleaning controller 144), a supporting body cleaning controller (e.g., belt roller cleaning controller 145), a cleaning liquid supply controller 146, a cleaning power recovery controller 147, and a flushing controller 148.

The inkjet printer 100 may select one of a normal print mode, an ejection failure inspection mode, a conveyance failure inspection mode, an image sensor cleaning mode, a belt back surface cleaning mode, a belt roller cleaning mode, a cleaning liquid supply mode, a cleaning power recovery mode, and a flushing mode. In the normal print mode, an image desired by an operator may be printed on a sheet. In the ejection failure inspection mode, each of the inkjet heads 2 may eject ink on the outer peripheral surface of the conveying belt 8 to form a test chart, the image sensor 41 may read an image of the test chart, and an ejection failure may be inspected based on the read image. In the conveyance failure inspection mode, the image sensor 41 may read an image on the sheet, which is conveyed by the conveying belt 8, and a conveyance failure may be inspected by calculating a shift amount of the sheet from a reference position in the main-scanning direction, an inclination angle of the sheet with respect to the conveying direction, and the like, based on the read image. In the image sensor cleaning mode, the cleaning roller 50 may clean the reading surface of the image sensor 41. In the belt back surface cleaning mode, the cleaning roller 50 may clean the back surface, that is, the inner peripheral surface of the conveying belt 8. In the belt roller cleaning mode, the cleaning roller 50 may clean the peripheral surface of the belt roller 6. In the cleaning liquid supply mode, the cleaning roller 50 may be supplied with cleaning liquid by driving of a cleaning liquid supply pump 80. In the cleaning power recovery mode, the adhesive roller 60 may restore the cleaning power of the cleaning roller 50. In the flushing mode, flushing may be performed successively for the plurality of inkjet heads 2.

The control unit 101 may select the mode of the inkjet printer 100 based on establishment of a predetermined condition, and may control operations of the printer components in accordance with the selected mode. For example, when the number of printed sheets has reached a predetermined number, the inkjet printer 100 may successively select the ejection failure inspection mode and the conveyance failure inspection mode before printing by a larger number of sheets than the predetermined number in the normal print mode. Also, the inkjet printer 100 may select the image sensor cleaning mode before the ejection failure inspection or the conveyance failure inspection is performed, for example, when an adhering ratio of foreign substances on the reading surface of the image sensor 41 is checked by any method and if the adhering ratio is higher than a predetermined value. Further, the inkjet printer 100 may successively select the belt back surface cleaning mode and the belt roller cleaning mode, for example, when the number of printed sheets has reached a predetermined number. Further, the inkjet printer 100 may select the cleaning liquid supply mode, for example, before the cleaning roller 50 performs cleaning after the cleaning roller 50 performed cleaning a predetermined number of times, before the cleaning roller 50 performs cleaning after the adhesive roller 60 removed foreign substances adhering on the cleaning roller 50 in the cleaning power recovery mode, or every time cleaning is completed. The inkjet printer 100 may select the cleaning power recovery mode, for example, when cleaning has been performed a predetermined number of times. Herein, cleaning may be an operation in which the cleaning roller 50 contacts the image sensor 41, the inner peripheral surface of the conveying belt 8, or the belt roller 6 for a predetermined period, so as to remove foreign substance. The inkjet printer 100 may select the flushing mode, for example, before printing is performed since printing has not been performed for a predetermined period, or when the result of the inspection in the ejection failure inspection mode is determined as an ejection failure. The control unit 101 may determine the mode to be selected by the inkjet printer 100 when a condition other than the condition described above is established, based on a command transmitted from a personal computer (PC) 200 through a user operation.

The print controller 141 may control a head drive circuit 121 so that ink is ejected from the corresponding inkjet head 2 in accordance with print data received from the PC 200 when the inkjet printer 100 is in the normal print mode.

When the inkjet printer 100 is in the normal print mode, the conveyance controller 142 may control a motor driver 122 so that the pickup roller 22 is rotated by driving of the pickup motor 132 and thus a top sheet in the sheet tray 21 may be fed onto the conveying belt 8. Also, the conveyance controller 142 may control a motor driver 123 so that the belt roller 6 is rotated by driving of a conveyance motor 133 and thus the sheet may be conveyed while the sheet is held on the outer peripheral surface of the conveying belt 8. Further, the conveyance controller 142 may control the motor driver 123 so that the rotation of the belt roller 6 is stopped when the driving of the conveyance motor 133 is stopped after the sheet on the conveying belt 8 reaches the discharge unit 12. Also, the conveyance controller 142 may stop driving of the suction fan 30. The conveyance controller 142 may perform similar control to that in the normal print mode when the inkjet printer 100 is in the ejection failure inspection mode or the conveyance failure inspection mode.

Referring to FIG. 4A, when the inkjet printer 100 is in the image sensor cleaning mode, the conveyance controller 142 may control the motor driver 123 so that the belt roller 6 is rotated by driving of the conveyance motor 133, and that the conveying belt 8 travels until the conveying belt 8 reaches and is stopped at a cleaning position in which the through hole 8*x* is arranged between the image sensor 41 and the cleaning roller 50 at the home position indicated by the dotted line.

Here, the conveyance controller 142 may determine that the conveying belt 8 has reached the cleaning position when the image sensor 41 detects the through hole 8*x*, and then perform the above-described control.

When the inkjet printer 100 is in the image sensor cleaning mode, in the state in which the conveying belt 8 is stopped at the cleaning position by the control of the conveyance controller 142, the image sensor cleaning controller 143 may control the moving mechanism 70 so that the cleaning roller 50 is lifted from the home position indicated by the dotted line, is passed through the through hole 8*x*, and reaches a position in which the cleaning roller 50 contacts the reading surface of the image sensor 41 while the cleaning roller 50 is deformed by pressure. Then, in the state in which the cleaning roller 50 is in contact with the reading surface of the image sensor 41 while the cleaning roller 50 is deformed by the pressure, the image sensor cleaning controller 143 may control the moving mechanism 70 so that the cleaning roller 50 is rotated clockwise in FIG. 4A. At this time, the cleaning roller 50 may be rotated by a predetermined number of times while the cleaning roller 50 is in contact with the entire length of the image sensor 41 in the main-scanning direction (i.e., direction orthogonal to the sheet plane of FIG. 4A). With the operation of the cleaning roller 50, the reading surface of the image sensor 41 may be cleaned, that is, foreign substances adhering on the reading surface may be removed.

Figure 4B:
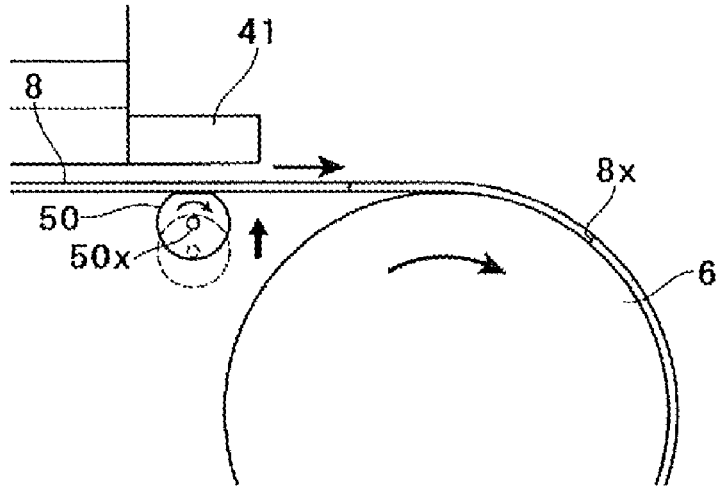

Referring to FIG. 4B, when the inkjet printer 100 is in the belt back surface cleaning mode, the belt back surface cleaning controller 144 may control the moving mechanism 70 so that the cleaning roller 50 is lifted from the home position indicated by the dotted line and reaches the inner peripheral surface of the conveying belt 8 while the cleaning roller 50 is deformed by pressure. At this time, the conveying belt 8 may be stopped so that an upstream-end portion of the through hole 8*x* in the conveying direction is located at a position slightly downstream of the cleaning roller 50. Then, in the state in which the cleaning roller 50 is in contact with the inner peripheral surface of the conveying belt 8, the conveyance controller 142 may control the motor driver 123 so that the belt roller 6 is rotated by driving of the conveyance motor 133 and thus the conveying belt 8 may travel. Accordingly, the cleaning roller 50 may be rotated clockwise in FIG. 4B by the travel of the conveying belt 8. Hence, the cleaning roller 50 may clean the inner peripheral surface of the conveying belt 8. That is, the cleaning roller 50 may remove foreign substances adhering on the inner peripheral surface. In the cleaning operation, the substantially entire inner peripheral surface of the conveying belt 8 may be cleaned when a downstream-end portion of the through hole 8*x* in the conveying direction has reached a position slightly upstream of the cleaning roller, that is, when the conveying belt 8 travels by substantially one revolution.

Figure 4C:
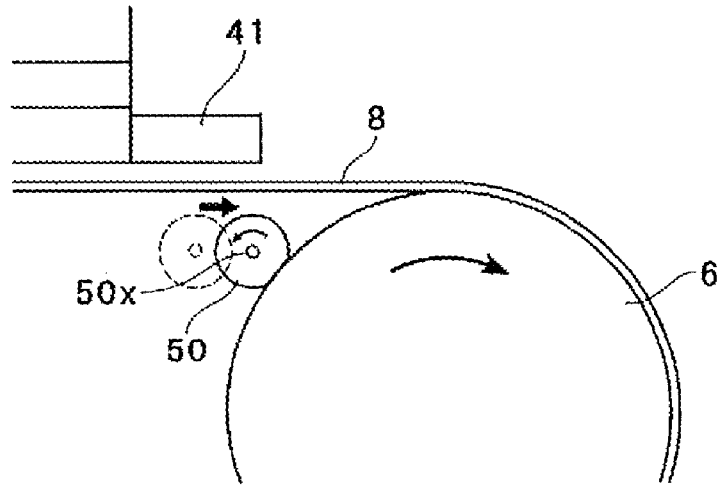

Referring to FIG. 4C, when the inkjet printer 100 is in the belt roller cleaning mode, the belt roller cleaning controller 145 may control the moving mechanism 70 so that the cleaning roller 50 is moved from the home position indicated by the dotted line to the right side in FIG. 4C and reaches a position in which the cleaning roller 50 contacts the belt roller 6 while the cleaning roller 50 is deformed by pressure. At this time, the conveying belt 8 may be stopped. Then, the conveyance controller 142 may control the motor driver 123 so that the belt roller 6 is rotated by driving of the conveyance motor 133 while the cleaning roller 50 is in contact with the belt roller 6. Accordingly, the cleaning roller 50 may be rotated counterclockwise in FIG. 4C by the rotation of the belt roller 6. Hence, the cleaning roller 50 may clean the peripheral surface of the belt roller 6. That is, the cleaning roller 50 may remove foreign substances adhering on the peripheral surface. In the cleaning operation, the belt roller 6 may be rotated by one revolution or more, thereby cleaning the substantially entire peripheral surface of the belt roller 6.

When the inkjet printer 100 is in the cleaning liquid supply mode, the cleaning liquid supply controller 146 may control driving of the cleaning liquid supply pump 80 so that the cleaning roller 50 is supplied with the cleaning liquid.

Figure 5:
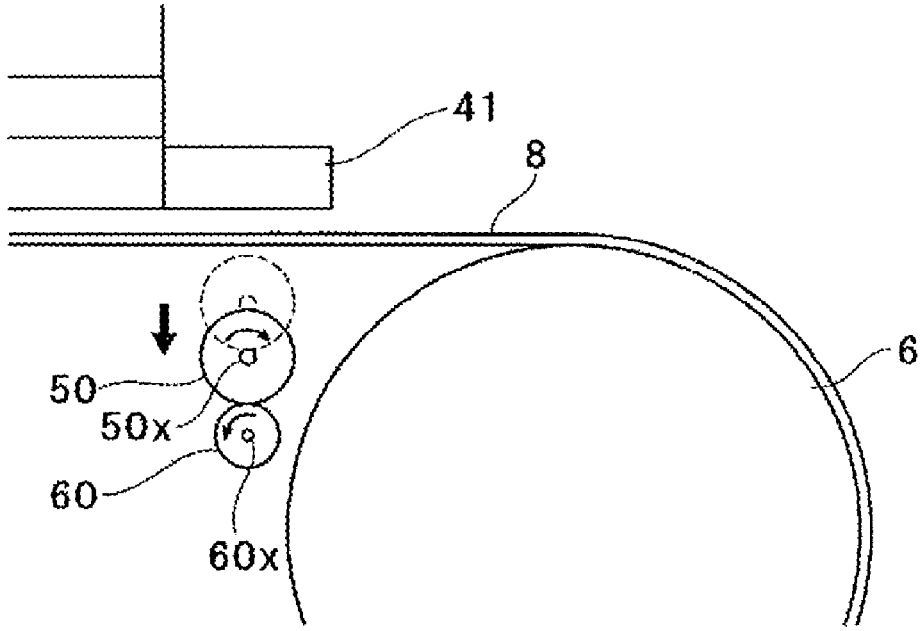
FIG. 5 is an enlarged view of the region IV surrounded by the dotted-chain line in FIG. 1, FIG. 5 illustrating an operation of the cleaning roller in a cleaning power recovery mode.

Referring to FIG. 5, when the inkjet printer 100 is in the cleaning power recovery mode, the cleaning power recovery controller 147 may control the moving mechanism 70 so that the cleaning roller 50 is lowered from the home position indicated by the dotted line and reaches the position in which the cleaning roller 50 contacts the adhesive roller 60 while the cleaning roller 50 is deformed by pressure. Then, the cleaning power recovery controller 147 may control the moving mechanism 70 so that the cleaning roller 50 is rotated clockwise in FIG. 5, in the state in which the cleaning roller 50 is in contact with the adhesive roller 60 while the cleaning roller 50 is deformed by the pressure. At this time, the cleaning roller 50 may be rotated a predetermined number of times while the cleaning roller 50 is in contact with the entire length of the adhesive roller 60 in the main-scanning direction (e.g., direction orthogonal to the sheet plane of FIG. 5). Accordingly, foreign substances adhering on the surface of the cleaning roller 50 may be transferred onto the adhesive roller 60, thereby restoring the cleaning power of the cleaning roller 50.

When the inkjet printer 100 is in the flushing mode, the flushing controller 148 may control the motor driver 123 so that the belt roller 6 is rotated by driving of the conveyance motor 133 and the conveying belt 8 travels until the through hole 8*x* reaches and is stopped at a position facing the ejection surface 3*a* of the inkjet head 2 located at the most upstream side in the sheet conveying direction. Then, the flushing controller 148 may control the head drive circuit 121 so that ink is forcibly ejected from the inkjet head 2 located at the most upstream side. After the flushing is performed for the inkjet head 2 located at the most upstream side, the flushing controller 148 may control the motor driver 123 so that the conveying belt 8 travels until the through hole 8*x* reaches and is stopped at a position facing the ejection surface 3*a* of the inkjet head 2 arranged directly downstream of the former inkjet head 2. In this way, the flushing may be performed for the inkjet heads 2 successively from the upstream side.

As described above, with the ink jet printer 100 of this embodiment, the image sensor 41 may be able to be cleaned in the image sensor cleaning mode by using the through hole 8*x* without moving the image sensor 41. Accordingly, a mechanism for moving the image sensor 41 may be not required. The configuration of the device may be able be simplified.

The through hole 8*x* may have the size through which the cleaning roller 50 may be able to be passed. The cleaning roller 50 may be passed through the through hole 8*x* and may contact the image sensor 41 under the control of the image sensor cleaning controller 143. Accordingly, the image sensor 41 may be able be further effectively cleaned.

The member for cleaning the image sensor 41 may be the cleaning roller 50. The cleaning roller 50 may be rotated while the cleaning roller 50 is in contact with the image sensor 41 under the control of the image sensor cleaning controller 143. Accordingly, the image sensor 41 may be able to be further effectively cleaned.

A length of the cleaning roller in an axial direction thereof may be the same as or greater than a length of the reading surface of the image sensor 41 in the same direction. The cleaning roller 50 may be rotated while in contact with the entire length of the reading surface of the image sensor 41 in the axial direction under the control of the image sensor cleaning controller 143. Accordingly, the entire area in the axial direction of the reading surface of the image sensor 41 may be able to be efficiently cleaned.

The cleaning roller 50 may contact the image sensor 41 while the cleaning roller 50 is deformed by the pressure as shown in FIG. 4A under the control of the image sensor cleaning controller 143. Accordingly, the image sensor 41 may be able to be further effectively cleaned.

The cleaning roller 50 may be supplied with the cleaning liquid by driving of the cleaning liquid supply pump 80 before the cleaning roller 50 performs cleaning. Accordingly, the cleaning roller 50 containing the cleaning liquid may further effectively clean the image sensor 41.

Although the cleaning power of the cleaning roller 50 may decrease in accordance with time lapse or the number of cleaning operations, the adhesive roller 60 may periodically restore the cleaning power of the cleaning roller 50. Accordingly, the cleaning power may be able to be kept in good condition, and the image sensor 41 may be able to be further effectively cleaned.

The conveyance controller 142 may control the driving of the conveying belt 8 so that the conveying belt 8 is stopped when the image sensor 41 detects the through hole 8*x*. Accordingly, it may be not necessary to additionally provide a member for detecting the through hole 8*x*.

Referring to FIG. 4B, although foreign substances are likely to adhere on the inner peripheral surface of the conveying belt 8 because the conveying belt 8 has the through hole 8*x*, the foreign substances may be able to be removed from the conveying belt 8 because the cleaning roller 50 contacts the inner peripheral surface of the conveying belt 8.

In the belt back surface cleaning mode, the conveying belt 8 may travel while the cleaning roller 50 is in contact with the inner peripheral surface of the conveying belt 8. Accordingly, the cleaning roller 50 may be rotated by the travel of the conveying belt 8 even though the cleaning roller 50 is not solely rotated. Thus, the inner peripheral surface of the conveying belt 8 may be able to be efficiently cleaned.

The conveying belt 8 in this illustrative embodiment may comprise the plurality of suction holes 8*y*. Hence, although foreign substances are likely to adhere on the inner peripheral surface of the conveying belt 8, the likelihood of the adhesion of the foreign substances may be able to be reduced by cleaning the inner peripheral surface of the conveying belt 8.

Referring to FIG. 4C, since the conveying belt 8 has the through hole 8*x*, foreign substances are likely to mix into the back side, that is, into the loop of the conveying belt 8 and adhere on the belt roller 6, and an operational error, such as slipping, may be found in the conveying belt 8, the foreign substances may be able to be removed from the belt roller 6 because the cleaning roller 50 contacts the belt roller 6. Thus, the operational error may be able to be reduced.

In the belt roller cleaning mode, the belt roller 6 may be rotated while the cleaning roller 50 is in contact with the belt roller 6. Accordingly, the cleaning roller 50 may be rotated by the rotation of the belt roller 6 even though the cleaning roller 50 is not solely rotated. Thus, the belt roller 6 may be able to be efficiently cleaned.

Since the peripheral edge 8*z* of the through hole 8*x* in the conveying belt 8 is reinforced, durability of the conveying belt 8 may be able to be secured.

In the flushing mode, the flushing may be able to be performed while the inkjet head 2 is held at the position in the normal print mode, that is, at the position facing the conveying belt 8, without moving the inkjet head 2 to, for example, a dedicated space in which a flushing tray is provided, the flushing tray not facing the conveying belt 8 (i.e., a space on the front side, or a space on the back side, of the sheet plane in FIG. 1). Thus, a head moving mechanism may be not required when the flushing is performed. The configuration of the device may be able to be simplified.

In the image sensor cleaning mode, the cleaning roller 50 may contact a substantially center region in the sub-scanning direction (i.e., left-right direction in FIG. 4A) of the reading surface of the image sensor 41, but may not contact the end portions in the same direction. However, since the detection by the image sensor 41 is performed at the substantially center region, an erroneous detection by the image sensor 41 may be able to be prevented by removing foreign substances adhering on the region.

Although an illustrative embodiment of the present invention has been described in detail herein, the scope of the invention is not limited thereto. It will be appreciated by those of ordinary skill in the relevant art that various modifications may be made without departing from the scope of the invention. Accordingly, the embodiments disclosed herein are exemplary. It is to be understood that the scope of the invention is not to be limited thereby, but is to be determined by the claims.

For example, the member for cleaning the image sensor 41 is not limited to a cylindrical member elongated along the shaft 50*x* like the cleaning roller 50 of the above-described illustrative embodiment. For example, a plate-shaped member or a spherical member may be used, or a blower or the like may be used. When the blower is used as a cleaning member, the cleaning member may be not passed through the through hole 8*x*, and may be driven at a given position within the loop of the conveying belt 8. Accordingly, foreign substances adhering on the reading surface of the image sensor 41 may be able to be removed by a blast from the blower.

In the above-described illustrative embodiment, while the cleaning roller 50 may be entirely formed of the porous material, it is not limited thereto. As long as a portion, which contacts the image sensor 41, of the cleaning roller 50 may be formed of the porous material, cleaning may be performed by applying the cleaning liquid to the portion. Also, the entire cleaning roller 50 may not have to be elastic. As long as a portion, which contacts the image sensor 41, of the cleaning roller 50 may be elastic, the cleaning roller 50 may contact the reading surface of the image sensor 41 while the cleaning roller 50 is deformed by pressure. Further, the material of the cleaning roller 50 may be not limited to the elastic porous material, and any of various materials may be used.

In the above-described illustrative embodiment, while the cleaning is performed by applying the cleaning liquid to the cleaning roller 50, the cleaning liquid or the like may not have to be applied. When the cleaning roller 50 is formed of a porous material, very small irregularities may be formed in the surface of the cleaning roller 50. Accordingly, the image sensor 41 may be more effectively cleaned as compared with a case in which the surface of the cleaning roller 50 is smooth.

The length of the cleaning roller 50 in the axial direction may not have to be equivalent to the length of the reading surface of the image sensor 41 in the same direction. As long as the length of the cleaning roller 50 in the axial direction is longer than the length of the reading surface in the same direction, an advantage may be attained such that the entire area in the axial direction of the reading surface of the image sensor 41 can be efficiently cleaned. Alternatively, the length of the cleaning roller 50 in the axial direction may be smaller than the length of the reading surface in the same direction.

In the above-described illustrative embodiment, while the through hole 8*x* may have the same size as that of the ejection surface 3*a* of the inkjet head 2 so as to be used for the flushing, it is not limited thereto. The through hole 8*x* may have a long shape substantially similar to a plane shape of the cleaning roller 50. Also, the through hole 8*x* may not have to have a size through which the cleaning roller 50 can bepassed. For example, when the blower is used as the cleaning member as described above, a long though hole 8*x* corresponding to the substantially center region in the sub-scanning direction (i.e., left-right direction in FIG. 4A) of the reading surface of the image sensor 41 may be formed. Accordingly, the region particularly used for the detection in the reading surface of the image sensor 41 may be cleaned by the blast from the blower.

The peripheral edge 8*z* of the through hole 8*x* may not have to be reinforced.

In the above-described illustrative embodiment, while the adhesive roller 60 may be provided as a recovery portion for restoring the cleaning power of the cleaning roller 50, it is not limited thereto. Any of various members or means may be used instead as long as the member or means has a function of restoring the cleaning power of the cleaning roller 50. Alternatively, a recovery portion may be omitted.

While the conveyance controller 142 may determine that the conveying belt 8 has reached the cleaning position when the image sensor 41 detects the through hole 8*x*, it is not limited thereto. A sensor other than the image sensor 41 may detect the through hole 8*x* instead.

While the cleaning roller 50 may contact the inner peripheral surface of the conveying belt 8 and the peripheral surface of the belt roller 6, and then the travel of the conveying belt 8 and the rotation of the belt roller 6 may be started, in the belt back surface cleaning mode shown in FIG. 4B and in the belt roller cleaning mode shown in FIG. 4C, it is not limited thereto. As long as the conveying belt 8 travels or the belt roller 6 is rotated in the state in which the cleaning roller 50 is in contact with the inner peripheral surface of the conveying belt 8, or in the state in which the cleaning roller 50 is in contact with the belt roller 6, the cleaning roller 50 is rotated accordingly. Thus, either of the contact, and the travel or rotation, may be performed first. Alternatively, in the belt back surface cleaning mode and the belt roller cleaning mode, the cleaning roller 50 does not have to be rotated by the travel of the conveying belt 8 and the rotation of the belt roller 6, and the cleaning roller 50 may be solely rotated by the moving mechanism 70.

In the above-described illustrative embodiment, while the cleaning roller 50 may cleans the inner peripheral surface of the conveying belt 8 and the belt roller 6 in addition to the image sensor 41, the cleaning of the inner peripheral surface of the conveying belt 8 and the belt roller 6 may be optional.

The conveying belt 8 may be supported by three or more rollers. The conveying belt 8 does not have to be a suction type. For example, the conveying belt 8 may be an adhesive type in which the outer peripheral surface of the conveying belt 8 may be treated with silicone, and a sheet is held on the outer peripheral surface by an adhesive force. The conveying member is not limited to an endless belt such as the conveying belt 8. The conveying member may be a drum which is circumferentially rotated to convey a recording medium while the recording medium is held on the outer peripheral surface.

In the above-described illustrative embodiment, while the test chart may be formed on the outer peripheral surface of the conveying belt 8 in the ejection failure inspection mode, it is not limited thereto. The test chart may be formed on a sheet, i.e., recording medium. In this case, the image sensor 41 may read an image of the test chart formed on the sheet.

A recording device of the invention is not limited to an inkjet type, and may be applied to a thermal type. Also, a recording device of the invention is not limited to a line type, and may be applied to a serial type in which a head is moved in a reciprocation manner. Further, a recording device of the invention is not limited to a printer, and may be applied to a facsimile, a copier, or the like. A recording medium conveying device of the invention may be installed in any of the recording devices described above.

What is claimed is:

1. A recording device, comprising:

a conveying member having a through hole, the conveying member conveying a recording medium, which is placed on a first surface of the conveying member on a front side;

a reading member arranged to face the first surface of the conveying member, the reading member reading an image on the first surface or an image on the recording medium on the first surface; and a cleaning member arranged to face a second surface of the conveying member on a back side, at a position facing the reading member with the conveying member interposed therebetween, the cleaning member configured to clean the reading member.

2. The recording device according to claim 1, further comprising:

a conveyance controller for controlling driving of the conveying member including driving the conveying member to a cleaning position in which the through hole is arranged between the cleaning member and the reading member.

3. The recording device according to claim 2, further comprising:

a cleaning controller for controlling the cleaning member to clean the reading member when the conveying member is located at the cleaning position.

4. The recording device according to claim 3, wherein the cleaning controller causes the cleaning member to pass through the through hole and contact the reading member during a cleaning operation.

5. The recording device according to claim 4, wherein the cleaning member is a roller, and wherein the cleaning controller causes the cleaning member to rotate while in contact with the reading member during the cleaning operation.

6. The recording device according to claim 5, wherein the cleaning member has an axis extending in parallel to the second surface of the conveying member and extending orthogonally to a conveying direction of the recording medium, a length of the cleaning member in an axial direction being greater than or equal to a length of the reading member in the same direction.

7. The recording device according to claim 1, wherein the through hole is configured to allow the cleaning member to pass through during a cleaning operation.

8. The recording device according to claim 3, wherein a portion of the cleaning member, which contacts the reading member, is elastic.

9. The recording device according to claim 3, wherein a portion of the cleaning member, which contacts the reading member, includes a porous material.

10. The recording device according to claim 9, further comprising:

a cleaning liquid supply portion which supplies cleaning liquid to the portion of the cleaning member, which contacts the reading member; and cleaning liquid supply controller for causing the cleaning liquid supply portion to supply the cleaning liquid to the portion of the cleaning member, which contacts the reading member, before the cleaning member cleans the reading member in a cleaning operation.

11. The recording device according to claim 1, further comprising a removal portion which removes contaminants from the cleaning member.

12. The recording device according to claim 1, wherein the reading member is configured to detect the through hole and the conveyance controller causes the conveying member to stop when the reading member detects the through hole.

13. The recording device according to claim 1, further comprising a conveying member cleaning controller for causing the cleaning member to contact the second surface of the conveying member during a conveying member cleaning operation.

14. The recording device according to claim 13, wherein the conveying member cleaning controller causes the cleaning member to contact the second surface of the conveying member.

15. The recording device according to claim 13, wherein the conveying member comprises a plurality of suction holes, the recording device further comprising a suction portion which sucks air through the suction holes to hold the recording medium on the first surface of the conveying member.

16. The recording device according to claim 1, wherein the conveying member is an endless belt which is wound around at least two supporting bodies and is conveyed by driving of the supporting bodies, and wherein the recording device further comprising:

a supporting body cleaning controller for causing the cleaning member to contact one of the supporting bodies.

17. The recording device according to claim 16, wherein the supporting body cleaning controller controls the driving of the cleaning member such that the cleaning member contacts the one of the supporting bodies while the supporting bodies are driven.

18. The recording device according to claim 1, wherein a peripheral edge of the through hole of the conveying member is reinforced.

19. The recording device according to claim 1 further comprising:

a recording head having an ejection surface which ejects liquid, the ejection surface being arranged to face the first surface of the conveying member; and recovery controller for causing the liquid to be ejected from the ejection surface when the through hole faces the ejection surface.

20. A method comprising:

providing a reading member facing a first surface on a front side of a conveying member, the conveying member having a through hole;

providing a cleaning member at a position facing a second surface on a back side of the conveying member, the position facing the reading member with the through hole interposed therebetween;

moving the conveying member to position the through hole between the reading member and the cleaning member; and cleaning the reading member with a cleaning member that passes through the through hole of the conveying member.

21. The method of claim 20, further comprising detecting when the through hole of the conveying member is between the reading member and the cleaning member; and stop moving the conveying member when the reading member detects the through hole of the conveying member is between the reading member and the cleaning member.

* * * * *